US005440380A

United States Patent [19]

Takeda

[11] Patent Number: 5,440,380

[45] Date of Patent: Aug. 8, 1995

[54] IMAGING FORMING APPARATUS HAVING TRANSFER MATERIAL CARRYING MEMBER FOR CARRYING TRANSFER MATERIALS

[75] Inventor: Kenji Takeda, Yokohama, Japan

[73] Assignee: Canon Kabushiki Kaisha, Tokyo, Japan

[21] Appl. No.: 134,668

[22] Filed: Oct. 13, 1993

[30] Foreign Application Priority Data

Oct. 13, 1992 [JP] Japan ..... 4-300475

[51] Int. Cl.[6] ..... G03G 15/16; G03G 15/01

[52] U.S. Cl. ..... 355/271; 355/326 R

[58] Field of Search ..... 355/271, 272, 274, 326, 355/327

[56] References Cited

U.S. PATENT DOCUMENTS 4,723,145 2/1988 Takada et al. ..... 355/3 TR
4,733,281 3/1988 Yoshinaga et al. ..... 355/14 R
5,086,318 2/1992 Takeda et al. ..... 355/271
5,121,163 6/1992 Muramatsu et al. ..... 355/246
5,130,758 7/1992 Takeda et al. ..... 355/315

*Primary Examiner*—R. L. Moses
*Attorney, Agent, or Firm*—Fitzpatrick, Cella, Harper & Scinto

[57] ABSTRACT

An image forming apparatus has an image bearing member, a first developing device containing a first color toner, a second developing device containing second color toner, wherein the first and second developing device are selectively switched, a transfer material carrying member capable of carrying a plurality of transfer materials each capable of receiving first and second color toner images and provided therebetween a first interval and a second interval which is larger than the first interval, such a region of the image bearing member as is passed through the developing position upon switching operation between the first developing device and the second developing device when the plurality of the transfer materials are carried on the transfer material carrying member, meets such a region of the transfer material carrying member as has the second interval, at the transfer position.

7 Claims, 6 Drawing Sheets

IMAGING FORMING APPARATUS HAVING TRANSFER MATERIAL CARRYING MEMBER FOR CARRYING TRANSFER MATERIALS

FIELD OF THE INVENTION AND RELATED ART

The present invention relates to an image forming apparatus, more particularly to an image forming apparatus in which images are formed on transfer materials by transferring toner images from an image bearing member formed through an electrophotographic process or electrostatic recording process. As an example of such an image forming apparatus, there are monochromatic, or full-color electrophotographic copying machine or recording machine.

Various image forming apparatuses such as copying machine or printer or the like has been put into practice. Among them, an image forming apparatus for forming a color image through an electrophotographic process is widely used. An example of such an image forming apparatus will be described. The apparatus comprises a photosensitive drum for forming an image on its peripheral surface, a plurality of developing devices for developing color-separated images on the photosensitive drum. The color separated and developed images are superimposedly transferred onto a transfer material (generally plain paper). The transfer material is carried on a transfer drum. The transfer material fed from a sheet accommodating portion such as a sheet cassette or the like is held at a predetermined position on the transfer drum in synchronism with the color images on the photosensitive drum. The images are transferred, and thereafter, the transfer material is separated from the transfer drum. The image is fixed on the transfer material by the fixing device. FIG. 7 shows an exemplary image forming apparatus of this type.

In such an apparatus, the transfer drum is capable of carrying thereon a plurality of transfer materials at regular interval or intervals. For example, two A4 size (JIS) sheets are supported on the transfer drum with the long side of the sheet parallel with the generating line of the transfer drum. The switching of the developing devices for the separated colors, is carried out during the period in which such a region of the photosensitive drum as corresponds to the most downstream interval between the transfer materials in the direction of the movement of the periphery of the transfer drum passes by the developing device comprising the plurality of developing devices.

However, in the conventional structure, shown in FIG. 3, the plurality of transfer materials P1 and P2 are supported with regular intervals d on the transfer drum 9, and therefore, the interval d between the adjacent transfer materials is definitely determined on the basis of the size of the transfer materials P1 and P2 and the outer diameter of the transfer drum 9. The interval between the transfer materials means the interval between a trailing edge of a transfer sheet and a leading edge of the next adjacent transfer material. For example, when the transfer material 9 has a diameter of 160 mm, and the A4 size sheets are used (297 mm$\times$210 mm), the interval d between the transfer materials P1 and P2, if two sheets are carried, is $160\times\pi/2-210\approx41.2$ mm. If the operation speed of the apparatus is increased (the peripheral speed of the transfer drums increased) with the diameter of the transfer drum 9 maintained, the time period usable for switching the developing device reduces to the time period which is the interval between transfer materials divided by the peripheral speed of the transfer drum 9. Therefore, the switching speed of the developing device is required to be increased. The reduction of the time period tends to significantly influence the transferred image due to the impact to the photosensitive drum resulting from the movement of the developing device. When the developing devices are switched relative to the photosensitive drum by parallel motion, the time period required for moving through the maximum distance may exceed the usable period. If so, the speed increase of the apparatus is substantially limited.

U.S. Pat. No. 5,086,318 discloses that two transfer materials are carried on the transfer drum with non-regular intervals. However, it does not disclose the developing device switching timing.

SUMMARY OF THE INVENTION

Accordingly, it is a principal object of the present invention to provide an image forming apparatus having a high productivity.

It is another object of the present invention to provide an image forming apparatus in which the image quality deterioration due to the impact resulting from the switching of the developing device is prevented.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The embodiments of the present invention will be described in conjunction with the accompanying drawings.

Figure 1:
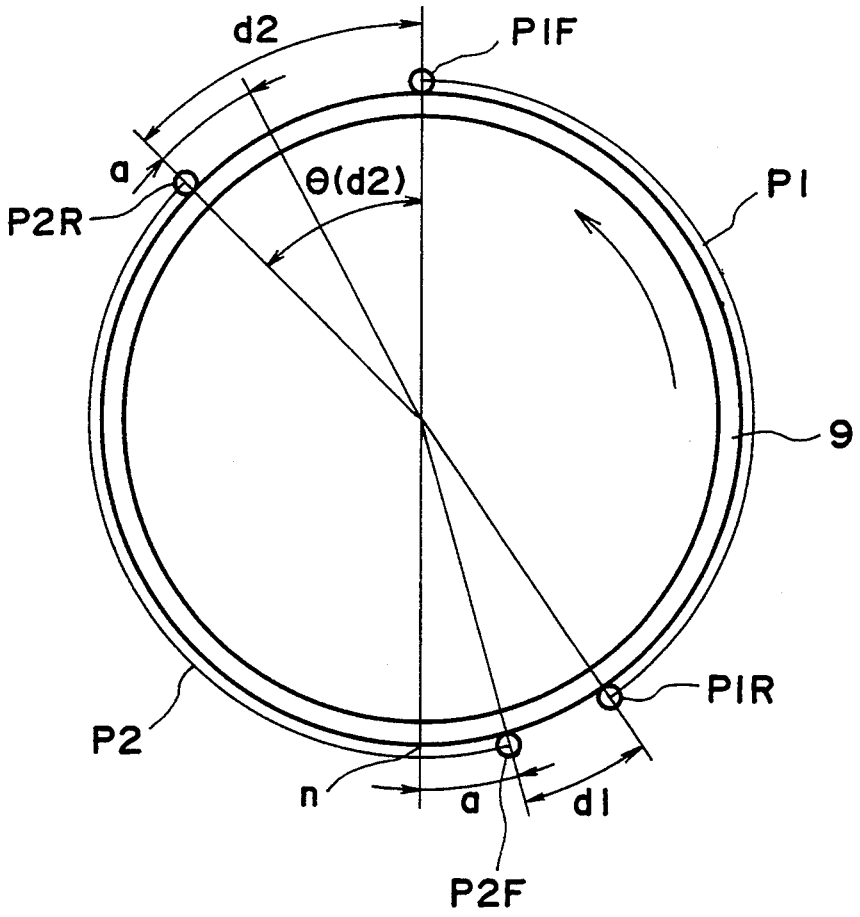
FIG. 1 is a sectional view illustrating a transfer drum carrying a transfer material.
Figure 2:
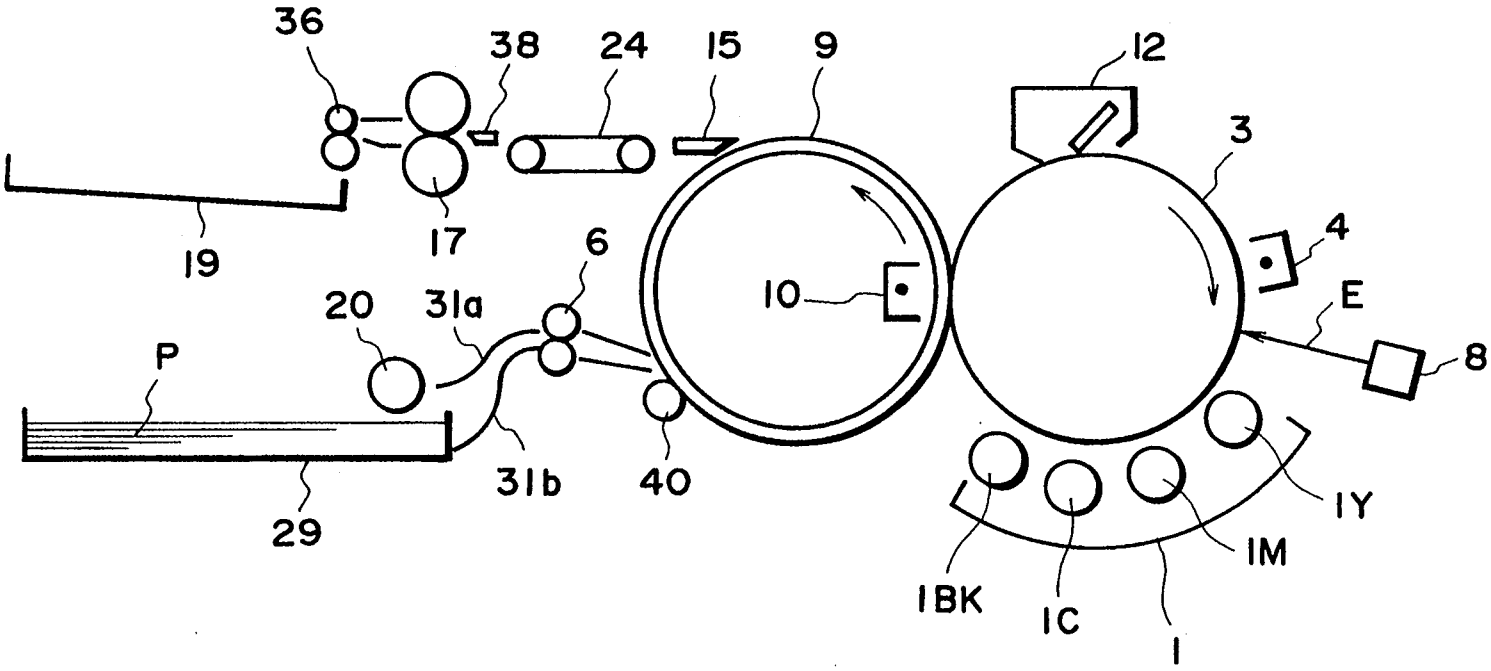
FIG. 2 is a sectional view of a general structure of an image forming apparatus according to an embodiment of the present invention.

FIG. 2 is a longitudinal sectional view of an image forming apparatus. FIG. 1 illustrates the transfer drum carrying the transfer material, according to an embodiment of the present invention.

Figure 3:
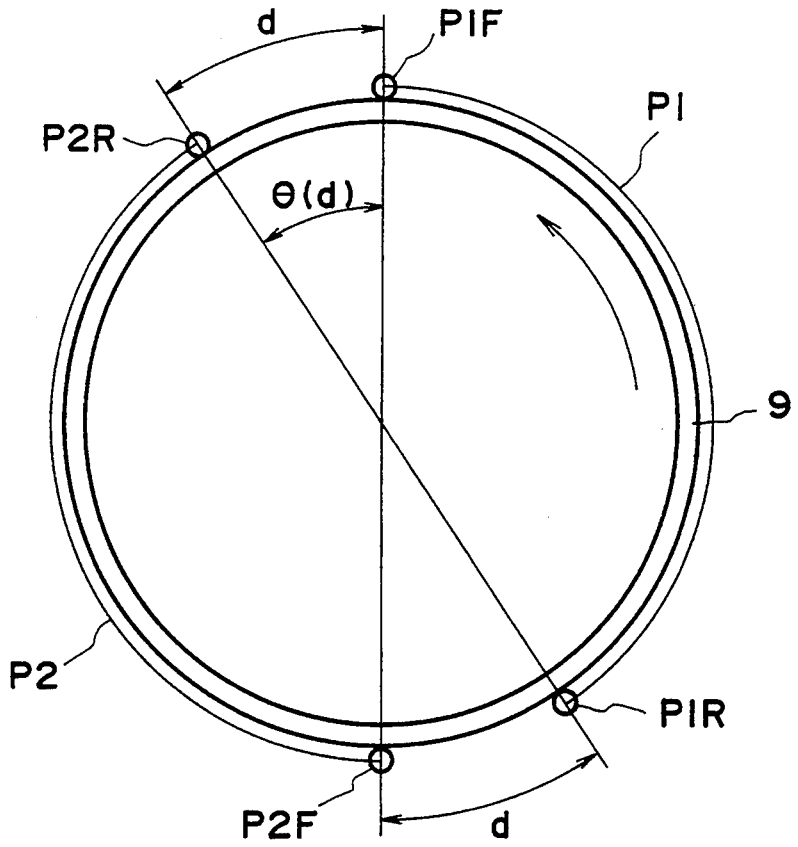
FIG. 3 is a sectional view illustrating a transfer drum for carrying transfer materials, in a conventional manner.

FIG. 3 illustrates the transfer drum carrying the transfer material, in a conventional manner.

Figure 4:
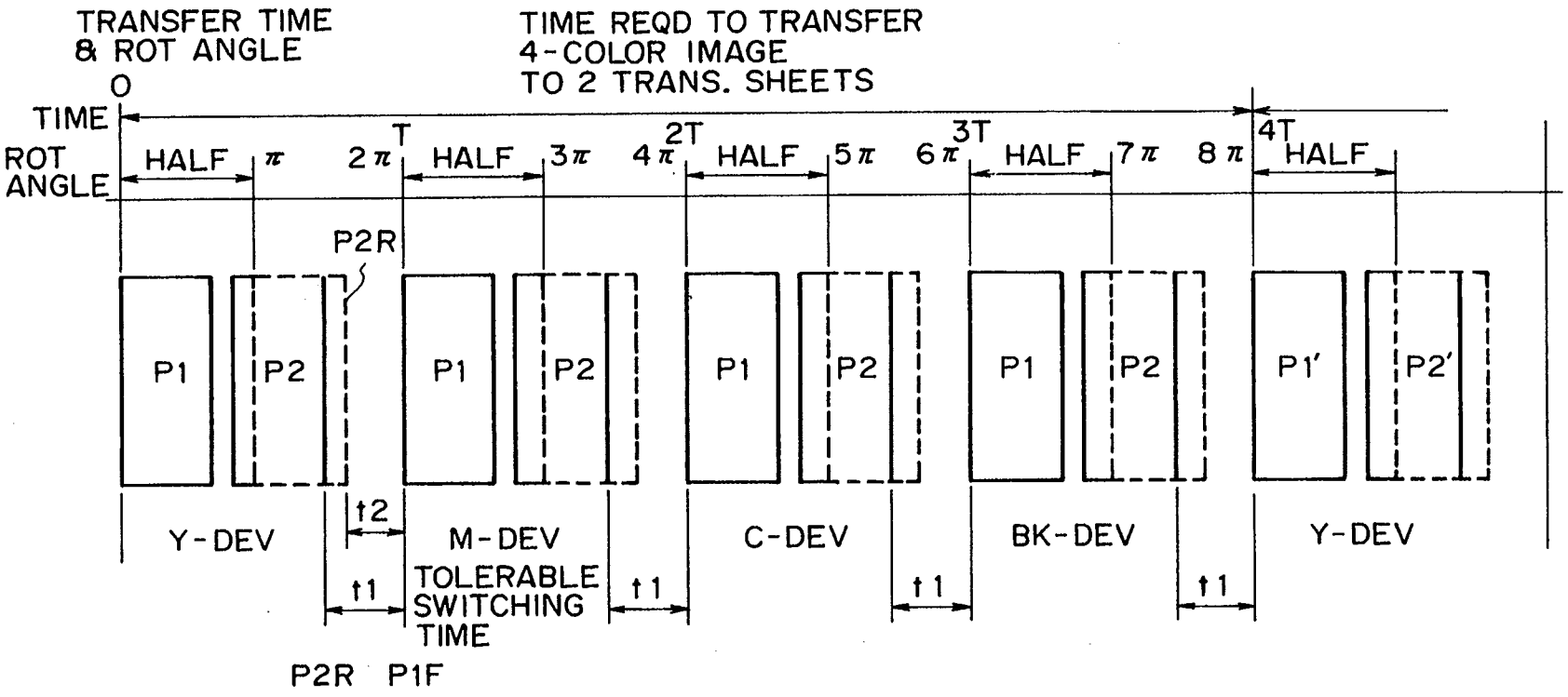
FIG. 4 is an expanded view of a transfer drum illustrating a relationship among location of the transfer drum, a position where the transfer material is carried, a switching of the developing device.
Figure 5:
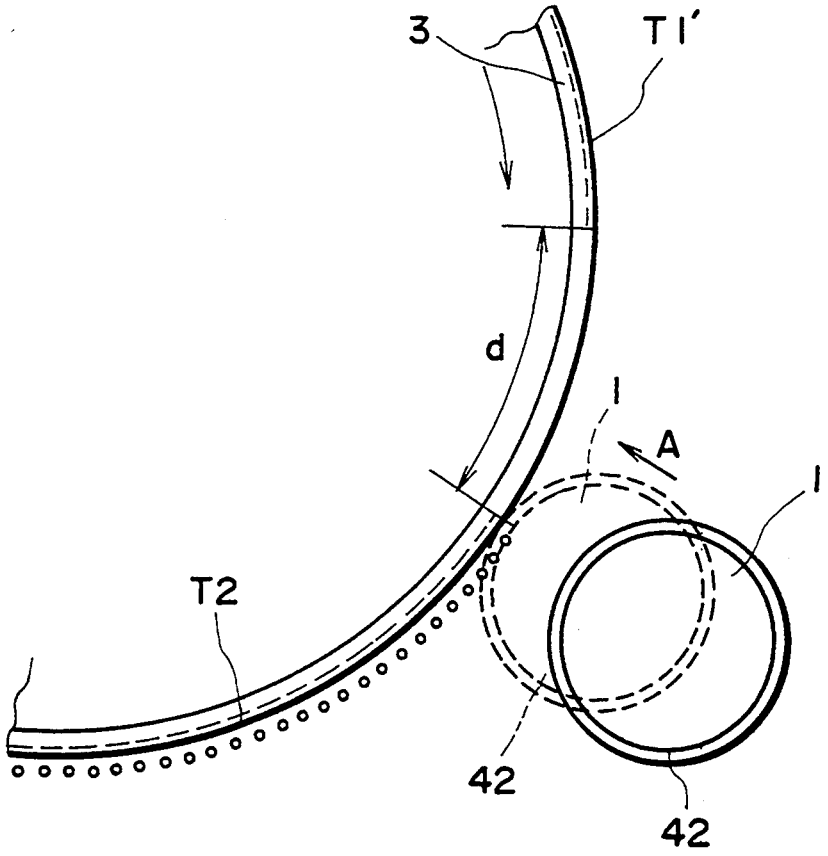
FIG. 5 is a sectional view of a structure around developing position, illustrating switching of the developing device adjacent the photosensitive drum.
Figure 6:
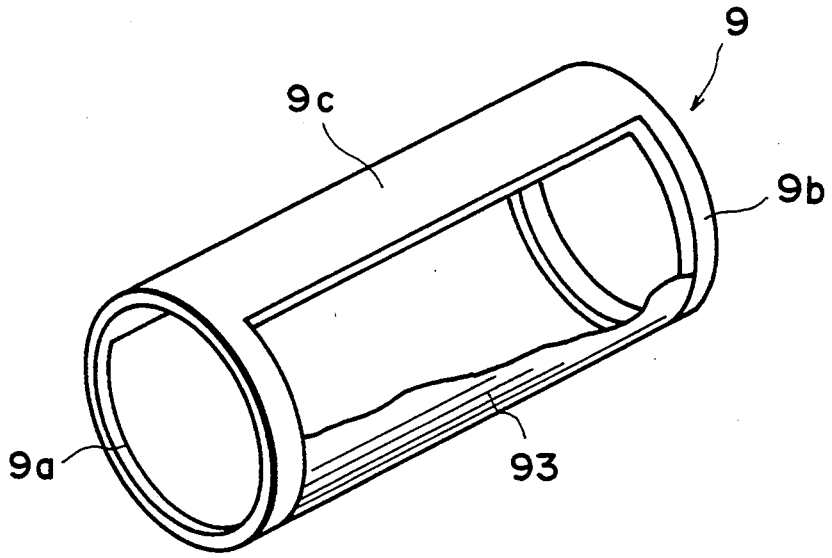
FIG. 6 is a perspective view of a transfer drum.
Figure 7:
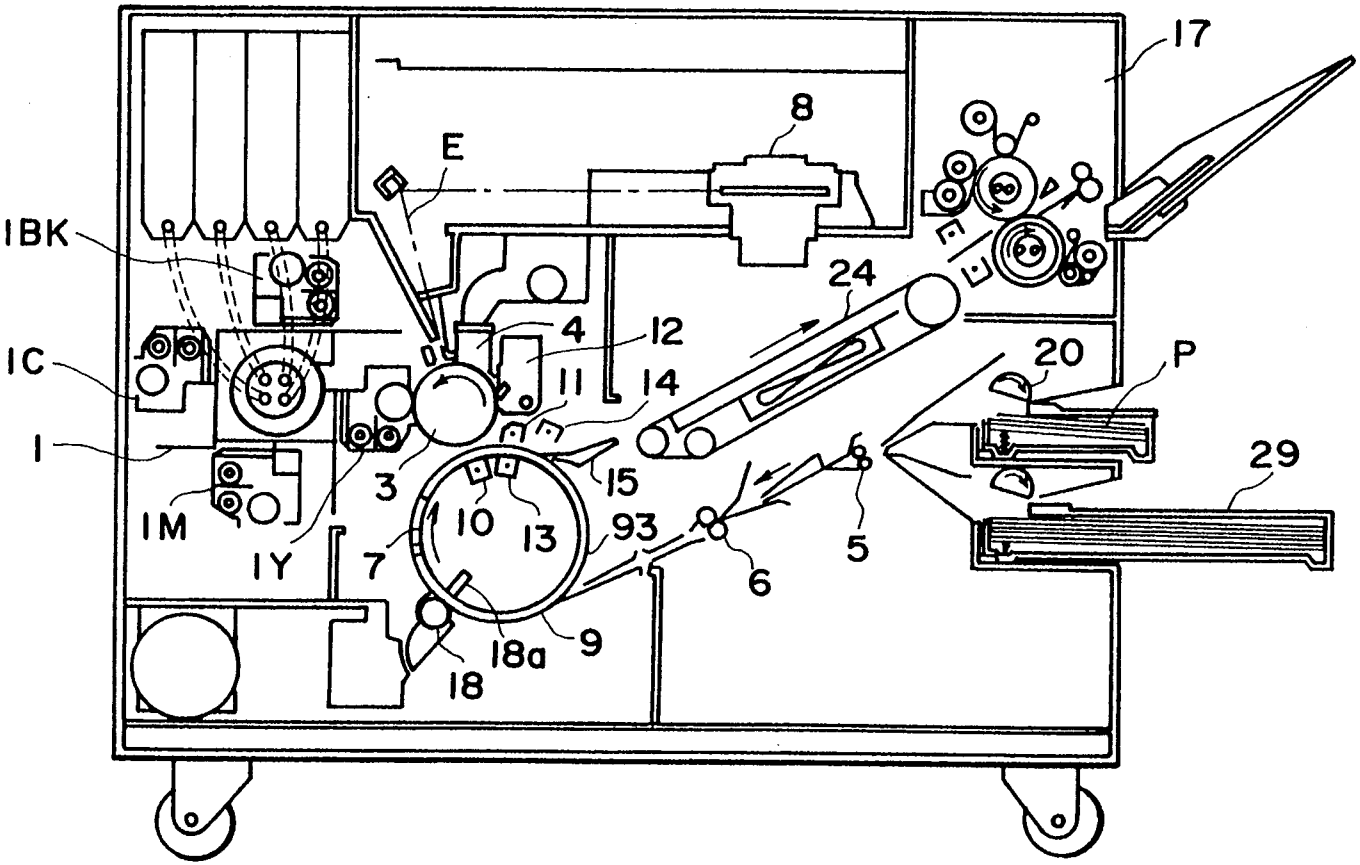
FIG. 7 is a sectional view of a conventional color electrophotographic printer.

FIG. 4 shows a comparison among rotation of the transfer drum, the transfer material supporting position and the switching of the developing device, in the apparatus of the present invention and also in the conventional image forming apparatus. FIG. 5 illustrates the switching of the developing device relative to the photosensitive drum. FIG. 6 is a perspective view of a transfer drum shown in FIG. 1.

Referring to FIG. 2, the description will first be made as to the image forming apparatus. In FIG. 2, around the photosensitive drum 3 which is a photosensitive member on which the image is to be formed in accordance with image information, there are provided a primary charger 4 for charging the surface of the drum, developing device 1 for developing an electrostatic latent image formed by image exposure light E from exposure means 8 in the form of a laser scanner or the like, a cleaning device 12 for removing developer (toner) remaining on the drum after the image transfer.

When the photosensitive drum 3 is rotated in the clockwise direction, it is charged by the primary charger 4. It is then, exposed to image light E carrying image information (reflected light from the original surface (not shown) or the like), through a scanning optical system or another exposure means 8. The electrostatic latent image is developed at a developing position by the developing device 1 into a toner image. The developing device 1 comprises developing devices 1Y, 1M, 1C and 1BK, which contains yellow, magenta, cyan and black toners, respectively. By the combination of the toners, full-color recording is possible.

To the periphery of the photosensitive drum 3, a transfer drum 9 which is a transfer material carrying member is contacted. Inside the transfer drum 9, there is a transfer charger 10 for charging the transfer material P to the polarity opposite from that of the toner image formed on the photosensitive drum 3. The transfer drum 9 has the same outer diameter as the photosensitive drum 3. It carries a plurality of transfer materials on its peripheral surface to permit the transfer materials to receive the toner image from the photosensitive drum 3.

Upstream of the transfer drum 9 with respect to the transfer material feeding direction, there is a sheet feeding cassette 9 containing stacked transfer materials P. The transfer material P stacked on the sheet feeding cassette 29 is fed to a registration roller 9 (synchronous feeding means) along guiding members 31*a* and 31*b* by feeding roller 20, from the topmost one. The leading of the transfer material P abuts a nip formed by registration rollers 6. The registration rollers feed the transfer material P to an attraction roller 40. The attraction roller 40 is effective to electrostatically attract the transfer material P on the transfer drum 9. Thereafter, the transfer material P is carried on the transfer drum 9 to be synchronous with the visualized image on the photosensitive drum 3.

Downstream of the transfer drum 9, there are provided separation claws 15 for separating the transfer material P from the peripheral surface of the transfer drum 9, conveying device 24, a fixing device inlet guide 39, a fixing device 17 for fixing the transferred image on the transfer material P, discharging rollers for discharging the transfer material P after the image fixing operation, sheet discharge tray 19 for stacking the discharged transfer materials P.

In operation, the transfer material P is fed from the sheet cassette 29 by feeding roller 20 to the registration roller 6, by which the oblique feeding is corrected. The registration roller 6 is synchronized with the toner image formed on the photosensitive drum 3, and is fed to between the photosensitive drum 3 and the transfer drum 9 past the attraction roller 40. The transfer position is formed between the photosensitive drum 3 and the transfer drum 9. The transfer material P fed to the transfer position is subjected to the superimposing image transfer. Then, it is separated from the transfer drum 9 by separation claws 15 and is fed to the fixing device 17. The fixing device 17 fuses and mixes the toner particles superposed on the transfer material P, thus fixing the toner images. The transfer material P, after being subjected to the image fixing operation, is discharged by the discharging rollers 36 onto the discharge tray 19. The transfer drum 9, as shown in FIG. 6, comprises opposing ring members 9*a* and 9*b*, a connecting portion 9*c* for connecting the ring portions 9*a* and 9*b*. They are made of metal. The cylindrical portion behind by the ring portions 9*a* and 9*b* and the connecting portion 9*c*, is covered by a dielectric sheet 93. A plurality of transfer materials can be carried on the dielectric sheet 93. If the transfer material is carried on the connecting portion 9*c*, the image can not be transferred to that portion, and therefore, the transfer material is not preferably carried on the connecting portion.

The positions of the transfer materials P on the transfer drum 9, will be described in comparison with the prior art example.

As described hereinbefore, FIG. 3 shows the transfer materials P1 and P2 carried on the transfer drum 9. The transfer drum 9 is capable of simultaneously carrying two transfer materials. From the easy control of the main assembly, the transfer materials P1 and P2 are carried on the transfer drum 9 at regular intervals d. For this reason, the leading edges P1*f* and P2*f* of the transfer materials P1 and P2, are positioned by 180 degrees distance on the transfer drum 9. Therefore, the interval d in the peripheral direction of the transfer drum 9 between the transfer materials P1 and P2, is determined. The switching among the developing devices 1Y, 1M, 1C and 1BK is required to be carried out when the region of the photosensitive drum 3 corresponding to the interval d passes by the developing device 1. FIG. 5 illustrates this. A developing device (1M, for example) is required to move itself to a proper position toward the photosensitive drum 3 surface to contact the developing roller 42 to the photosensitive member 3 in the direction indicated by an arrow A, before the leading edge of a latent image T1' to be formed by the developing device 1M to be used for the transfer material P1 (already having a yellow toner image T2), passing through the position where the visualized image T2 (to be transferred to the transfer material P2) already formed in a different color (yellow, for example) is faced to the developing device 1Y. Therefore, if an attempt is made to increase the peripheral speed of the photosensitive drum 3 (transfer drum 9 to increase the operational speed of the apparatus without changing the interval d, the developing device 1Y, 1M, 1C and 1BK has to be moved more quickly. The increase of the developing device moving speed increases the impact applied to the photosensitive drum 3, with the result of deterioration of the image quality.

FIG. 1 shows the transfer materials P1 and P2 carried on the transfer drum (transfer material carrying member) according to an embodiment of the present invention.

The leading edge P1F of the transfer material P1 and the leading edge P2F of the transfer material P2 are disposed so that the leading edge P2F of the transfer material P is not overlaid on the trailing edge P1R of the transfer material P1, and $d1<d2$ is satisfied where d1 is a distance between P1R and P2F, and d2 is a distance between P2R and P1F, with the transfer material P1 located upstream. In the conventional example, d2=d+a, where a is a deviation of the leading edge positions of the transfer material 2 of FIG. 1 and the transfer material P2 of FIG. 3. Therefore, the developing devices 1Y, 1M, 1C and 1BK can be switched during the period corresponding to the interval d2 between the transfer materials P1 and P2 which is longer than the interval between the transfer materials P1 and P2 in FIG. 3. Among the plurality of the developing devices, when the developing device selection is switched for the purpose of the toner image formation, there exists a region in which the toner image is not formed on the photosensitive drum 3, the region being the region which passes by the developing device upon the switching of the developing device. When this region passes through the transfer position, at least the region corresponding to the interval d2 of FIG. 1 is at the transfer position.

In other words, when the plurality of transfer materials are supported at non-regular intervals, the operational speed of the apparatus can be increased without introduction of the deterioration of the image quality.

The distance a between the leading edge P2f of the transfer material P2 and a point n of intersection between the transfer drum 9 and a line passing through the leading edge P1f of the transfer material P1 and the center, is determined on the basis of the peripheral speed of the transfer drum 9 and the outer diameter of the transfer drum 9 in the actual apparatus.

FIG. 4 is a time chart showing a relationship between the position of the transfer material and the transfer drum 9 with the time axis of rotational angle $\theta$ of the transfer drum when a full-color image is formed continuously using the transfer material carrying method shown in FIGS. 1 and 3. In this Figure, the broken line represents the conventional case as shown in FIG. 3.

FIG. 4 is an expanded view of a peripheral surface of the transfer drum 9. The transfer drum 9 rotates through four full-turns until the transfer operations are completed for the transfer materials P1 and P2. The time required is 4T, and time T is required for one rotation of the transfer drum 9. The transfer of one color is effected during T−t1 in each of the rotations of the photosensitive drum 9. In the conventional example, it is effected during T−t2.

When the images are transferred continuously onto two transfer materials, the transfer material P1 which is spaced more from the preceding transfer material, as shown in FIG. 4, is subjected to the image transfer prior to the image transfer for the transfer material P2 which is spaced less from the preceding transfer material. By doing so, the productivity is improved.

The switching between the developing devices 1Y, 1M, 1C and 1BK is effected, during the period t1 ($t1=\theta(d2)/\omega$) or t2 ($t2=\theta(d)/\omega$), that is, an angle formed ($\theta(d2)$ or $\theta(d)$) about the center of the transfer drum 9 by the circumferential length d2 or d between the trailing edge P2R of the transfer material P2 and the lading edge P1F of the transfer material P1, in FIGS. 2 or 3.

As will be apparent from FIG. 4, the time period t1 usable for the switching of the developing device with the transfer material carrying method of this invention, is longer than the switching period t2 with the conventional example, and therefore, the developing device can be switched without influence to the function and performance of the apparatus. Conversely, it is possible to reduce the switching speed to increase the performance. The time period t1 may be smaller than the time period required for the actual switching of the developing device. In order to prevent the difference of the rotational speed between the ring portions 9*a* and 9*b* of the transfer drum, it is desirable to increase the rigidity by increasing the width of the connecting portion 9*c* of the transfer drum. Therefore, it is preferable that the connection portion 9*c* is within the interval d2.

In this embodiment, while two toner images of the same color to be transferred onto the transfer materials P1 and P2, are being formed on the photosensitive drum, the sleeve 42 (developer carrying member) of the developing device continues to rotate. In other words, the sleeve 42 continues to rotate for (T−t1) in FIG. 4 for one developing device, and the sleeve 42 does not stop even in the period from the completion of the toner image formation for the transfer material P1 to the start of the toner image formation for the transfer material P2. When the sleeve 42 continues to rotate while a plurality of toner images of the same color are being formed, it is preferable to reduce the rotation period of the sleeve 42 as much as possible to prevent the deterioration of the developer. Therefore, the rotation period of the sleeve 42 is preferably T−t1 rather than T−t2, in FIG. 4. In this embodiment, transfer materials P1 and P2 of A4 size are carried on the transfer drum. However, when an image is to be formed on A3 size transfer material, only one transfer material may be carried on the transfer drum. More particularly, according to this embodiment, the transfer drum can carry a plurality of transfer materials when the size of the transfer material is smaller than one half of the peripheral length of the transfer drum, and can carry only one transfer material when the size of the transfer material is larger than one half of the transfer length of the transfer material.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

first developing means for forming a toner image on said image bearing member at a developing position, said first developing means containing a first color toner;

second developing means for forming a toner image on said image bearing member at the developing position, said second developing means containing a second color toner, wherein said first and second developing means are selectively switched;

a transfer material carrying member capable of carrying a plurality of transfer materials, wherein the transfer materials carried on said transfer material carrying member are capable of receiving first and second color toner images from said image bearing member at a transfer position, and wherein the plurality of transfer materials provide therebetween a first interval and a second interval which is larger than the first interval;

wherein switching timing between said first developing means and second developing means and supply timing of the transfer materials to said transfer material carrying member are controlled such that a region of said image bearing member as is passed through the developing position upon switching operation between said first developing means and said second developing means when the plurality of the transfer materials are carried on said transfer material carrying member, meets such a region of said transfer material carrying member as has the second interval, at the transfer position; and wherein when the plurality of the transfer materials are carried on said transfer material carrying member, image transfer operation starts with the transfer material which is immediately downstream of the second interval with respect to a movement direction of said transfer material carrying member.

2. An apparatus according to claim 1, wherein said apparatus is capable of forming a full-color image.

3. An image forming apparatus comprising:

an image bearing member;

first developing means for forming a toner image on said image bearing member at a developing position, said first developing means containing a first color toner;

second developing means for forming a toner image on said image bearing member at the developing position, said second developing means containing a second color toner, wherein said first and second developing means are selectively switched;

a transfer material carrying member capable of carrying a plurality of transfer materials, wherein the transfer materials carried on said transfer material carrying member are capable of receiving first and second color toner images from said image bearing member at a transfer position, and wherein the plurality of transfer materials provide therebetween a first interval and a second interval which is larger than the first interval;

wherein switching timing between said first developing means and second developing means and supply timing of the transfer materials to said transfer material carrying member are controlled such that a region of said image bearing member as is passed through the developing position upon switching operation between said first developing means and said second developing means when the plurality of the transfer materials are carried on said transfer material carrying member, meets such a region of said transfer material carrying member as has the second interval, at the transfer position; and wherein said transfer material carrying member comprises opposing rings, and a connecting portion for connecting said rings, a carrying sheet covering a space defined by said ring portions and said connecting portion, and wherein said connecting portion is in the region of the transfer material carrying member of the second interval.

4. An apparatus according to claim 3, wherein said apparatus is capable of forming a full-color image.

5. An image forming apparatus comprising:

an image bearing member;

first developing means for forming a toner image on said image bearing member at a developing position, said first developing means containing a first color toner;

second developing means for forming a toner image on said image bearing member at the developing position, said second developing means containing a second color toner, wherein said first and second developing means are selectively switched;

a transfer material carrying member capable of carrying a plurality of transfer materials, wherein the transfer materials carried on said transfer material carrying member are capable of receiving first and second color toner images from said image bearing member at a transfer position, and wherein the plurality of transfer materials provide therebetween a first interval and a second interval which is larger than the first interval;

wherein switching timing between said first developing means and second developing means and supply timing of the transfer materials to said transfer material carrying member are controlled such that a region of said image bearing member as is passed through the developing position upon switching operation between said first developing means and said second developing means when the plurality of the transfer materials are carried on said transfer material carrying member, meets such a region of said transfer material carrying member as has the second interval, at the transfer position; and wherein said first developing means has a rotatable toner carrying member for carrying the first color toner, and a continuous rotation period of said toner carrying member corresponds to a time period required for the plurality of transfer materials carried on said transfer material carrying member to pass through the transfer position to transfer the first color toner.

6. An apparatus according to claim 5, wherein said apparatus is capable of forming a full-color image.

7. An image forming apparatus comprising:

an image bearing member;

a transfer material carrying member capable of carrying a plurality of transfer materials, wherein the transfer materials carried on said transfer material carrying member are capable of receiving an image from said image bearing member at a transfer position, and wherein the plurality of transfer materials provide therebetween a first interval and a second interval which is larger than the first interval;

wherein said transfer material carrying member includes a carrying sheet and a supporting member for supporting the carrying sheet, said supporting member extending in a direction substantially perpendicular to a movement direction of said transfer material carrying member, and wherein said supporting member is in the region of the transfer material carrying member of the second interval.

* * * * *

UNITED STATES PATENT AND TRADEMARK OFFICE

CERTIFICATE OF CORRECTION

PATENT NO. : 5,440,380
DATED : August 8, 1995
INVENTOR(S) : KENJI TAKEDA

It is certified that error appears in the above-indentified patent and that said Letters Patent is hereby corrected as shown below:

Title page, item [54]
"IMAGING" should read --IMAGE--.
Column [57] ABSTRACT,
line 5, "device" should read --devices--.
Column 1,
line 2, "IMAGING" should read --IMAGE--.
Column 3,
line 17, "then," should read --then--; and
line 24, "contains" should read --contain--.
Column 5,
line 60, "lading" should read --leading--.

Signed and Sealed this

Twenty-first Day of November, 1995

Bruce Lehman

*Attest:*

BRUCE LEHMAN

*Attesting Officer*

*Commissioner of Patents and Trademarks*